US006057255A

United States Patent [19]

Gass

[11] Patent Number: 6,057,255

[45] Date of Patent: May 2, 2000

[54] FLAT STRUCTURE PERMEABLE TO LIQUID, AND A METHOD FOR MANUFACTURING SUCH A STRUCTURE

[75] Inventor: Michael Gass, Derendingen, Switzerland

[73] Assignee: Conrad Munzinger & Cie AG, Switzerland

[21] Appl. No.: 08/913,878

[22] PCT Filed: Jan. 17, 1997

[86] PCT No.: PCT/EP97/00215

§ 371 Date: Sep. 24, 1997

§ 102(e) Date: Sep. 24, 1997

[87] PCT Pub. No.: WO97/27362

PCT Pub. Date: Jul. 31, 1997

[30] Foreign Application Priority Data

Jan. 25, 1996 [EP] European Pat. Off. ..... 96101069

[51] Int. Cl.[7] ..... B32B 27/34

[52] U.S. Cl. ..... 442/394; 442/183; 442/184; 442/286; 442/287; 442/290; 442/291; 442/293; 442/304; 442/329; 442/395; 442/398; 442/399; 442/401

[58] Field of Search ..... 442/183, 184, 442/286, 287, 290, 291, 293, 304, 329, 395, 398, 399, 401

[56] References Cited

FOREIGN PATENT DOCUMENTS

| | | |
|---|---|---|
| 342171 | 11/1989 | European Pat. Off. . |
| 187967 | 3/1990 | European Pat. Off. . |
| 653512 | 5/1995 | European Pat. Off. . |
| 8605219 | 9/1986 | WIPO . |
| 9521285 | 8/1995 | WIPO . |

*Primary Examiner*—Helen L. Pezzuto
*Attorney, Agent, or Firm*—Liniak, Berenato, Longacre & White, LLC

[57] ABSTRACT

A strip material (1) comprising a support (2) includes on at least one side a plastics layer (5, 6) which is plane on the outside and which is traversed by throughflow passages. In accordance with the invention, the outside (7, 8) of the plastics layer (5, 6) includes embossments (9) provided also between the orifices of the throughflow passages which at least in part inter-communicate and communicate with the throughflow passages. In the production of the strip material, during or after the production of the plastics layer (5, 6), soluble particles are applied onto the outside (7, 8) of the plastics layer (5, 6) and are then pressed into the plastics layer (5, 6), the soluble particles being leachable by a solvent of a type in respect of which the remainder of the strip material (1) is stable whereafter these soluble particles are dissolved out.

41 Claims, 1 Drawing Sheet

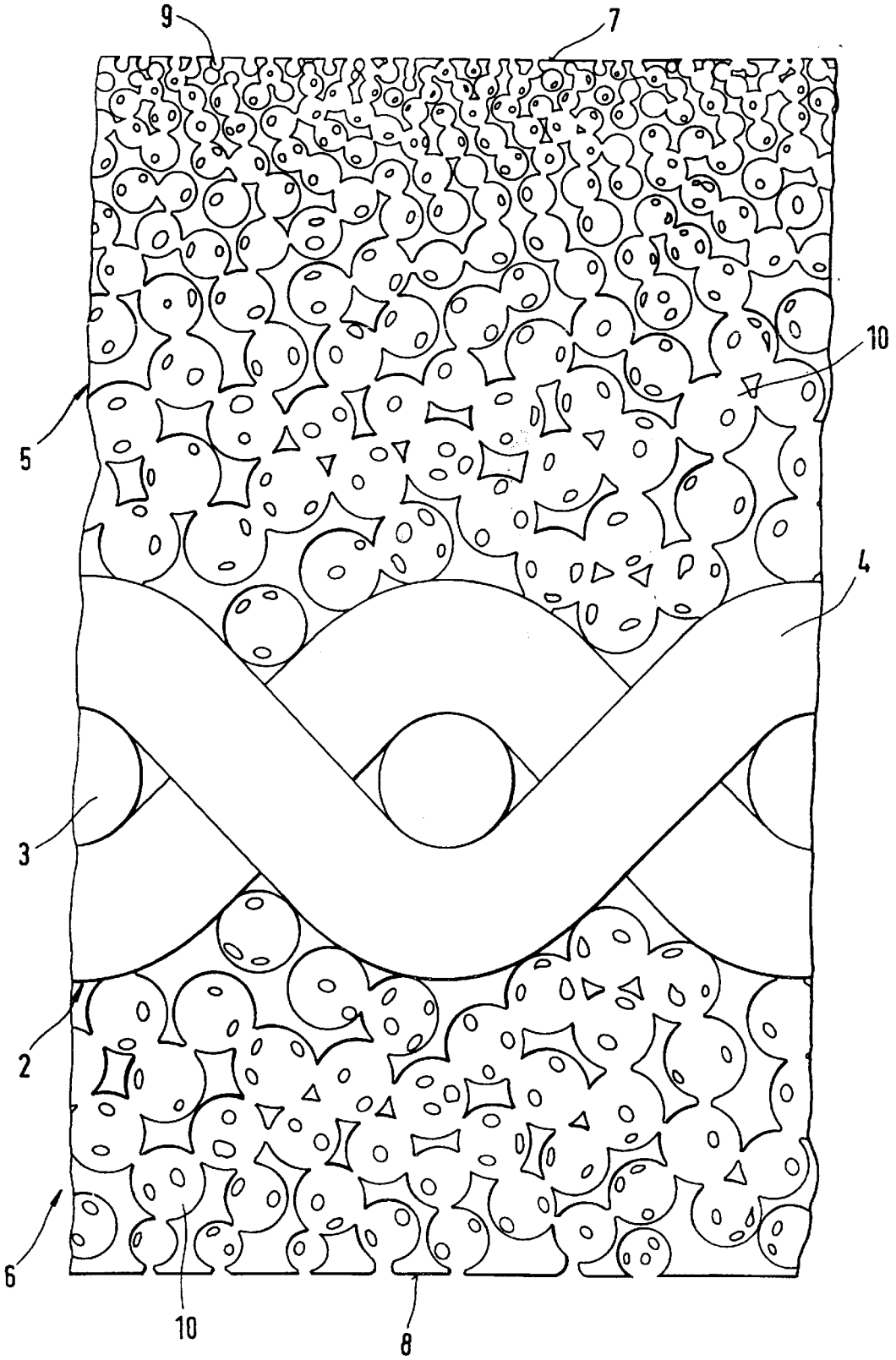
9
7
10
5
4
3
2
6
10
8

FLAT STRUCTURE PERMEABLE TO LIQUID, AND A METHOD FOR MANUFACTURING SUCH A STRUCTURE

The invention relates to a strip material comprising a support which, at least on one side, has a plastics layer, plane on the outside, traversed by throughflow passages. The strip material is particularly suitable for the manufacture of paper machine belts for the forming, pressing and drying region thereof, and of filter media, in this context, particularly of belt filter media.

A strip material of the aforesaid type for employment in a paper machine is described in EP-B-0 196 045. It comprises a support in the form of a liquid pervious fabric onto which a layer, 1,3 to 5 mm thick, of an elastomeric polymer resin has been applied. The plastics layer comprises throughflow passages which pass from the otherwise smooth and plane outside down to the support and which, in the paper machine, serve as dewatering passages.

The production of the throughflow passages is brought about in that textile fibres are homogeneously dispersed in the polymer resin, prior to the mixture of textile fibres and polymer resin being applied onto the support. As an alternative to the aforegoing, a fibre fleece may first be applied onto the support, whereafter the coating of polymer resin is applied. In both cases the textile fibres are composed of an organic material which can be dissolved by the application of a solvent, the plastics layer being resistant to this solvent. The leaching out of the textile fibres is carried out after the application of the polymer resin by the application of the solvent such that the throughflow passages are formed the configuration and orientation of which corresponds to the leached out textile fibres.

In a less preferred embodiment particulate corpuscles are proposed instead of the textile fibres which are distributed homogeneously in the polymer resin. Inorganic salts or their hydrates or oxides are proposed as the material for those corpuscles. By appropriate solvents they can be leached out of the polymer resin in the same manner as the textile fibres and in the course thereof leave behind pore cavities.

The manufacture of the above described paper machine belt involves difficulties because polymer resins are inclined, after curing, to form a closed surface which inhibits the dissolving out of the soluble textile fibres or corpuscles contained in the polymer resin. In order to solve this problem, it has been proposed in EP-B-EPO 273 613 to so grind down the surface of the plastics layer, that a communication is formed to the soluble fibres and in addition a smooth surface is generated. Such a grinding procedure, however, is very time consuming. Moreover, it is first necessary to apply an appropriate excess of plastics material and during the grinding procedure dust is formed which must be sucked off and be either disposed of or be processed for reuse. Moreover, a smooth surface is formed which inhibits a release of the paper strip from the paper machine belt. The reason is that paper strips are inclined to become firmly drawn against smooth surfaces.

Apart from the aforegoing disadvantages, paper machine belts of this genus are claimed to have a number of advantages as compared with known felt materials, according to the batt-on-base principle, more particularly an increased resistance against permanent deformation and thereby a longer operating life and resulting therefrom reduced maintenance costs, improved abrasion resistance and higher structural strength, lower affinity for contaminating substances as well as more uniform pressure distribution and thus improved de-watering charateristics.

The aforedescribed development was preceded by a proposal to embed in the fibres of a paper machine felt fibres or particles which can be leached out by means of a solvent in relation to which the remaining fibres and the support of the paper machine belt are solvent resistant, i.e. stable (DE-C-34 19 7 or 8). The manufacture proceeds such that a non-woven fibre web of insoluble fibres and soluble components is formed and is needle-bonded onto the support and that thereafter the paper machine belt is compacted with pressure and heat. In the course thereof the soluble components may melt together. Due to the resolution of the soluble components, pore cavities are formed which, in spite of the previous compression and the thereby generated high density, provide the paper machine belt with the void volume required for de-watering.

It is a disadvantage of this solution that, in spite of the compression, the durability is considerably less than with plastics coated supports. Moreover, the conventional machines for this purpose, in particular weaving looms and needling machines cannot be dispensed with.

There has been no lack of attempts to manufacture the paper machine belts comprising a plastics layer with a support and throughflow passages passing there through in a different manner. Thus in EP-B-0 037 387 a strip material is proposed in which the throughflow passages are produced by perforating a previously applied plastics foil by means of a laser apparatus. Apart from the fact that the throughflow passages do not intercommunicate for which reason a gas or water permeation transversely to the plane of the strip material cannot take place, the manufacture of such strip is moreover exceedingly expensive, in particular if major surface areas have to be processed by means of a laser device, as is the case with paper machine belts. Moreover, foils of the required width and having adequate uniformity cannot be produced.

It is proposed in WO 91/14558 to produce the throughflow passages in that onto the non-cured plastics layer a perforated mask is applied which is then radiated. Due to this radiation, the plastics material is cured fully in the region of the perforations of the mask. After removing the perforated mask the plastics material which then has not yet been cured is removed by compressed air. This process as well is expensive and leaves behind relatively large free surface areas and for that reason cannot be applied universally. Moreover, here as well waste material which has to be disposed of or recycled is formed.

A different concept was adopted in accordance with the proposal according to EP-B-0 187 967. In this case, in the context of a paper machine belt, a porous plastics layer on a support is created in that loose particles of a synthetic polymeric polymer resin of the order of magnitude of 0,15 to 5 mm are distributed on the surface of a support web and are then subjected to thermal treatment in which the polymer resin particles are heated above the softening point whereby they are fused together and to the support fabric at their contact localities. Instead or in combination therewith it is also possible to provide for the application of a resin-like binder. Instead of the particles, it is also possible to distribute loose fibres on the support fabric. After the adhesion of the particles or fibres to one another and to the support fabric, cavities remain which render the plastics layer liquid pervious.

Something similar is proposed in accordance with EP-A-0 653 512 except that in this case the material strip is initially produced exclusively from polymer particles which, by heat action, are inter-bonded at their contact localities. If required, a strengthening structure in the form of a reinforcing may be totally embedded in the belt thus formed. This may take the form of a pure fibre product or a fabric. The particles may also have different diameters in order to generate a permeability which increases towards the other side.

The disadvantage of strip materials produced according to this principle resides in that it is very difficult to produce them in a reproducible manner, in particular as regards permeability. Moreover, their surface is very uneven for which reason the simultaneous application of pressure and heat—wherever the particles are formed of fine fibres (EP-B-0 187 967)—or a grinding procedure (EP-A-0 653 512) are proposed for the purpose of rendering the surface even.

According to WO 95/21285 a polymer coating is applied by means of a transfer foil with the simultaneous application of heat and pressure onto a support in which context the polymer film due to the heat action is transformed on the transfer foil to coherent droplets with free spaces formed inbetween, as a result of which the plastics layer applied onto the support is porous. In this process as well, it is difficult to adjust the permeability of the plastics layer in a reproducible manner and to adapt it to whatever requirements are needed. Moreover, foils of the width required for that purpose are not available and would also not be producible with adequate uniformity.

The invention is based on the object to so design a strip material of the type referred to in the introduction, that it can be manufactured easily and in a time saving manner and in addition has favourable surface characteristics. A further object resides in that a simple and adaptable process for the manufacture of such strip material is to be provided.

The first mentioned object is attained in accordance with the invention in that the outside of the plastics layer includes embossments increasing its roughness also between the orifices of the throughflow passages. An increased roughness brought about by the embossment is of particular advantage when using the strip material as a paper machine belt because thereby the tendency of the paper strip to adhere too strongly to the paper machine belt is counteracted in spite of which no markings are caused. The paper belt is released substantially less problematically from the paper machine belt than in the case of the prior art constructions of the same genus as known from EP-B-0 196 045 and EP-B-0 273 613. These embossments, due to their distribution in relation to the apertures of the throughflow passages, are of such minimal size that an adequate contact area remains in relation to the paper strip in order to permit uniform support and pressure transfer. Moreover, the throughflow passages, jointly with the embossments, take care that the re-moistening of the paper strip after its leaving the press gap is quite minor.

The advantages of the surface of the plastics layer being roughened in accordance with the invention is not restricted, however, to employment in paper machines. In the case of filter media as well a surface which is too smooth may lead to so strong an adhesion of the separated material, that its stripping off is rendered difficult.

For the principle practical fields of employment embossments having a mean diameter of 5 to 100 $\mu$m are recommended.

The support of the material strip according to the invention has the object to lend configurational and structural strength to the material strip and, where applicable, to absorb longitudinal and transverse forces. In addition it is to be liquid pervious. For this purpose textile supports formed from filaments, for example non-woven filament webs, knitted, worsted or woven structures or combinations of such textile supports are particularly suitable. Depending on the field of employment and strength requirements, the support may be of single or multiple layer structure. In the case of a support fabric any type of fabric can be considered, in particular those of a type known per se in the field of paper machine belts. Mono-filaments as well as multiple filaments of preferably thermol plastic synthetic resin materials can be employed for the filaments. The support may in the alternative or in combination with the aforegoing also comprise a spun-bonded fibre fleece and/or a stamped or extruded reticulated structure. It may in addition be provided with a fibre fleece so that it has felt-like characteristics.

Synthetic resins as known in particular from the field of paper machine belts and as referred to in the above mentioned documents are suitable as materials for the support. The selection of the synthetic resins may be adapted to the particular field of employment and the conditions there prevailing. In particular, synthetic resins should be selected which do not suffer deterioration in the manufacture of the resin layer and the thermal exposure connected therewith.

A further feature of the invention provides that the throughflow passages are composed of a plurality of inter-communicating pore cavities. Such pore cavities may be formed by means of soluble particles in the manner known from EP-B-0 196 045. In this context the pore cavities may be so distributed that optimal properties are attained for the intended purpose. For application in the paper machine field it is recommended that the cavity volume increases towards the support, layer-wise or continuously, for example by increasing the number of pore cavities and/or the individual volumes of the pore cavities. Independently thereof, pore cavities which parallel to the plane of the synthetic resin layer adjoin one another should inter-communicate so that, in particular in the event that they are employed in the wet press of a paper machine, open pores and thereby de-watering volumes are made available also within the plane of the plastic layer and not only in a direction transverse to this plane. The mean diameter of the pore cavity should be in the range of from 30 to 500 $\mu$m.

A further feature of the invention provides that the plastic layer contains soluble components which can be leached out by means of a solvent to which the remainder of the material strip is stable and which are so distributed that after their dissolution additional throughflow passages are formed. Such a material strip provides the facility to modify the permeability after its installation, i.e. during operation, for example in order to increase the permeability once again to its original state, if the available throughflow passages in the course of the period of operation, due to dirt accumulation, have become constricted or clogged. This concept may in principle be found already in EP-A-0 303 798 and EP-A-0 320 559 in which the employment of soluble fibres within a felt has been proposed. It stands to reason that these soluble components must be stable under the conditions of employment for which the material strip is intended, i.e., when being employed as a paper machine belt, against the liquids or vapours of the liquors derived from the paper strip, or that the dissolution proceeds in a greatly retarded manner. By employing a particular solvent it is then possible to create additional throughflow passages which replace the clogged throughflow passages or which supplement the constricted throughflow passages. As regards the materials which may be used therefor, reference is made to the two aforesaid documents. Instead of fibres serving as soluble components it is also possible to employ particulate soluble corpuscles which should be so distributed that their dissolution results in inter-communicating pore cavities which combine to form throughflow passages.

Suitable for the plastics layer are polyamides such as polyamide 4.6, 6, 6.6, 6.10, 6.12, 11 and 12, polyesters, polyphenylsulphite, polyetheretherketone, polyurethane, polysulfone, thermoplastic aromatic polyamides, polyphthalamides as well as polypropylene. However, other polymers and elastomeric plastics such as disclosed, for example in EP-B-0 196 045 and EP-B-0 273 613 may also be used. Mixtures of different synthetic resins may also be used, for example having different elasticities in which case the plastics layer may also be formed of layers composed of plastics having different elasticities. In this respect as well the selection of the synthetic resins and their elastic properties may be adapted to the particular field of employment.

It is further proposed in accordance with the invention that the support comprises a plastics layer not only on one side, but is provided on both sides with a plastics layer. Such an embodiment is particularly suitable whenever the rear of the material strip is exposed to considerable mechanical wear and tear against which the support is to be protected. This may, for example be the case in the forming and pressing region of a paper machine, because there the paper machine belts are passed over stationary means such as suction boxes, support bars or the like. In that event, the second plastics layer should also comprise throughflow passages, the design, arrangement and production of the throughflow passages being providable in an analogous manner to the first plastics layer, so that the second plastics layer may comprise all the features described above for the first plastics layer. In order to likewise attain a permeability which increases towards the outside of the second plastics layer it is desirable for the number of the pore cavities and/or the individual volumes of the pore cavities to increase in the direction facing away from the support. In this context it is advantageous if the number and/or the volumes of the pore cavities in the plastic layers are in each case at least equal in the regions adjoining the support, preferably being greater in the second plastics layers than in the first plastics layer. However, for special purposes it may be advantageous for the number of the porous cavities and/or the individual volumes of the porous cavities in the second plastics layer to decrease in the direction facing away from the support, for example in order to avoid re-wetting of the paper strip during the separation of the paper strip from the paper machine belt.

It stands to reason that the outside of the second plastics layer may likewise be provided in the manner according to the invention with embossments between the apertures of the throughflow passages.

For moulding the embossments into the outside of the plastics layer(s) a variety of procedures may be employed. Thus, conceivably, the embossments may be produced with appropriately profiled rollers. However, according to the invention, a different procedure is preferred which is characterised in that during or after the production of the plastics layer soluble particles are applied onto the outside of the plastics layer, preferably in as even a distribution as possible and are then pressed into the plastics layer, the soluble particles being leachable by a solvent of a kind against which the remainder of the material strip is resistant, these soluble particles thereafter being leached out. The process is characterised by high adaptability and easy performance. By selecting the particle size of the soluble particles the roughness of the outside of the plastics layer can be adapted to the particular requirements. The number of embossments per surface area may likewise be adjusted by an appropriate distribution of the soluble particles when being sprinkled on. For pressing in the soluble particles ordinary roller presses such as calenders may be employed.

It is recommended that the soluble particles are pressed into the plastics layer at a temperature at which the plastics layer, as compared with its condition at room temperature, is softened, so that the soluble particles can penetrate readily into the plastics layer without the application of much pressure and the embossments after the dissolution of the particles essentially retain their configuration. In this context it is advantageous for the soluble particles to be applied and pressed in following on to the production of the plastics layer, when the temperature is still elevated, i.e. so that the heating of the plastics material for the purpose of producing the plastics layer on the support is utilised for the application, whereby renewed heating can be dispensed with.

The aforesaid procedure for forming the embossments is particularly suitable for those material strips which are manufactured in that the plastics layer is provided with soluble components which can be leached out to form throughflow passages by the action of such solvents in relation to which the remainder of the material strip is stable and that at least part of the soluble components present in the plastics layer and the soluble particles pressed in from the outside are leached out—preferably in a single process step. The reason is that by the impression of the soluble particles into the outside of the plastics layer, wherever the soluble components are present near the surfaceof the outside, a communication to these is established. After the leaching out of the soluble particles the solvent has access to the soluble components which initially are enclosed inside the plastics layer and therefore is able to dissolve and remove these completely. To that extent the embossments subsequently constitute the orifices to the throughflow passages. The process thus replaces the grinding treatment according to EP-B-0 273 613 quite independently of whether fibres or likewise particles have been embedded in the plastics layer to serve as soluble components.

For the manufacture of the plastics layer the processes apparent from EP-B-0 196 045 and EP-B-0 273 613 can be employed. However, a process was found to be particularly suitable in which initially a plastics powder is formed—e.g. by grinding, screening etc.—and the plastics powder and particulate soluble corpuscles serving as soluble components are applied onto the support and that by heat and pressure treatment a plastics layer containing soluble corpuscles and which is at least plane on the outside is formed from the plastics powder. The process is characterised by its simplicity and adaptability.

The particle size of the particles of the plastics powder and also that of the soluble corpuscles as well as their mixing ratio may be adjusted within wide limits for a desired structure of the plastics layer to result, in particular as regards the cavities of the throughflow passages resulting from the leaching of the soluble corpuscles. However, preferably the mean particle size of the plastics powder should be less than that of the soluble corpuscles, for example amounting to only one half to one third that of the soluble corpuscles and in no circumstances more than 100 $\mu$m. In this manner, the soluble corpuscles are virtually jacketed by a plurality and possibly even a multitude of corpuscles of the plastics powder and a comparatively dense packing result.

The mixing of the plastics powder and of the soluble particles may take place prior to the application onto the support or in the course thereof. The subsequent thermal treatment should take place at a temperature at which the plastics powder is plastified so much that subsequently a homogeneous plastics layer adhering to the support is formed, i.e. a plastics layer which apart from the soluble corpuscles is substantially non-porous. The application of pressure serves not only to facilitate this process but simultaneously to provide a plane surface, the roughness of which is subsequently determined by the soluble particles additionally to be impressed into the exposed surface. The heating in this context may proceed by infra-red radiation or in a heating oven etc. whilst the pressure application may be carried out with the aid of rollers, for example in a calender.

The plastics powder and the soluble corpuscles may also be applied in layers, there optionally being provided for the individual layers different particle sizes, materials and mixing ratios in order to allow for prevailing requirements. Thus the soluble corpuscles may increase in size in successive layers towards the support. Alternatively, or in combination with the aforegoing, it is also possible for the number of soluble corpuscles to increase in the direction towards the support from one layer to the next layer. Both expedients serve to increase the permeability in the direction towards the support, which is particularly desirable when using the material strip in the forming and pressing region of a paper machine.

The mixing ratio as well can be adapted within wide limits to the particular intended use. In order for throughflow passages to be formed to an adequate extent after the leaching out of the soluble corpuscles, the volume ratio between plastics powders and soluble corpuscles should be in the range ¼:¾ and ½:½, preferably in the range ⅔:⅓.

In order to simplify the process of leaching out the soluble components and the soluble particles, both should be made of the same material so that the leaching out can proceed in a single process step using a single solvent. Regarding the soluble components contained in the plastics layer substances should be selected which, when subjected to heating during the formation of the plastics layer, substantially retain their shape. For this purpose polymer fibres or particles can be used having a higher heat resistance than the plastics matrix into which the soluble components have been embedded. Advantageously these conditions should also apply in respect of the soluble particles pressed into the exposed surface of the plastics layer. However, particularly suitable for this purpose are inorganic substances and more particularly water-soluble salts such as NaCl, KCl and/or $CaCO_3$ as well as chlorides, carbonates and/or soluble sulphates of the alkaline or alkaline earth elements or metals as well as those other salts which are apparent from DE-C-34 19 708. Such soluble particles or corpuscles are not impaired by the heat treatment necessary for the formation of the plastics layer and are readily free-flowing and therefore suitable for sprinkling. Also suitable are organic substances, for example carbohydrates (sugar) or salts of organic acids such as citric acid, ascorbic acid etc.

The invention further teaches that soluble components in the form of corpuscles are used the mean diameter of which is from 30 to 500 $\mu$m. For pressing into the exposed side of the plastics layer, soluble particles should be used the mean diameter of which is from 5 to 100 $\mu$m. The plastics powder should have admixed thereto anti-oxidants as are known, for example from U.S. Pat. No. 3,677,965 or U.S. Pat. No. 3,584,047.

A further aspect of the invention teaches that soluble components of at least two substances are used of which in each case one substance is leachable by a particular solvent to which the respective other substance(s) is/are resistant. This opens the possibility to initially leach out only one part of the soluble component and then after having installed the material strip and after a certain period of operation to leach out once or more times a group of further soluble components in order to restore the initial permeability of the material strip once the permeability has decreased in operation by choking up etc. It stands to reason that the components to be leached out in operation must either be resistant to the prevailing ambient and operating conditions or that they will only leach out of the matrix with a time delay and successively.

Finally, the invention teaches that a plastics layer may also be formed on the other side of the support. This may be done in a manner analogous to the first plastics layer, i.e. with the formation of a mixture of a plastics powder with soluble corpuscles and subsequent heat and pressure treatment. In this case as well, soluble particles should be pressed into and subsequently leached out of the outside of the plastics layer in order to adapt the roughness to the particular intended use and, in particular, to form apertures for communication with the soluble components embedded in the plastics layer so that these likewise may be leached out.

In the drawing the invention is further illustrated by way of a working example shown on a highly enlarged scale. It shows in cross-section a portion of a material strip 1. The material strip 1 comprises a support 2 in the form of a fabric having longitudinal filaments 3 and transverse filaments 4. On each of the upper and the underside of the support 2 a plastics layer 5, 6 is provided. The first plastics layer 5 has been produced in accordance with the process of the invention in that a mixture of a plastics powder and soluble corpuscles has been sprinkled onto the support 2 and both jointly have been subjected to a thermal and pressure treatment. Due to this a homogeneous plastics layer 5 including soluble corpuscles substantially uniformly distributed therein has been produced, the pressure treatment having resulted in a plane outer surface. Further soluble particles were then sprinkled onto the still heated and therefore plastically readily deformable exposed side 7 of the plastics layer 5 and subsequently pressed by means of pressure rollers or the like into the plastics layer 5. The lower plastics layer 6 was dealt with in an analogous fashion, in particular with regard to the treatment of its outside 8.

Thereafter, the material strip 1 was subjected to a treatment with a solvent for the soluble particles and corpuscles. During this treatment the soluble particles pressed into the exposed sides 7, 8 of the plastics layers 5, 6 were first leached out, leaving behind embossments—for example indicated by 9. These embossments 9, at least in part not only communicate with one another but also with the soluble corpuscles close to the outsides 7, 8 of the plastics layers 5, 6, so that the solvent can also reach those corpuscles and dissolve them. The dissolution results in the formation of pore cavities—as exemplified by 10—in the plastics layers 5, 6, having the configuration of the respectively leached out corpuscles and inter-communicating with one another. This provides a communication not only in a vertical direction but because of the uniform distribution of the soluble corpuscles, also in the horizontal direction. This provides a pore structure similar to an open pore plastics foam, the pore cavities coacting to form throughflow passages.

The pore cavities 10 of the plastics layer 5 on the upper side now increase in size from the region of the exposed side 7 towards the support 2. This may be brought about in that initially a mixture of plastics particles and relatively large soluble corpuscles and thereafter a further mixture of plastics powder and by comparison smaller soluble corpuscles is applied. In the case of the plastics layer 6 on the underside a plastics powder including even larger soluble corpuscles has been used so that the pore cavities 10 are larger than those of the plastics layer 3 on the upper side.

I claim:

1. Strip material comprising a support which, at least on one side, has a plastics layer on the outside traversed by throughflow passages, characterized in that the outside of the plastics layer includes embossments disposed about and roughening the outside of the plastics layer between the orifices of the throughflow passages and which at least in part communicate with one another and with the throughflow passages.

2. Strip material according to claim 1, characterised in that the embossments (9) have a mean diameter of from 5 to 100 $\mu$m.

3. Strip material according to claim 1, characterised in that the support (2) is a textile support formed by filaments.

4. Strip material according to claim 3, characterized in that the textile support is a web selected from the group consisting of knitted, worsted, and woven materials, and combinations thereof.

5. Strip material according to claim 1, characterised in that the support is a spun-bonded fibre fleece and/or comprises or is formed by a stamped or extruded reticulated structure.

6. Strip material according to claim 1, characterised in that the support includes a fibre fleece.

7. Strip material according to claim 1, characterised in that the throughflow passages are composed of a plurality of inter-communicating pore cavities (10).

8. Strip material according to claim 7, characterised in that the number of pore cavities (10) increases in the direction of the support.

9. Strip material according to claim 7, characterised in that the individual volumes of the pore cavities (10) increase in the direction towards the support.

10. Strip material according to claim 7, characterised in that adjoining pore cavities (10) as well inter-communicate.

11. Strip material according to claim 7, characterised in that the mean diameter of the pore cavities (10) is in the range of from 30 to 500 $\mu$m.

12. Strip material according to claim 1, characterised in that the plastics layer (5, 6) includes soluble components, which can be leached out by a solvent in relation to which the remainder of the strip material is stable and which are so distributed that after the leaching thereof additional throughflow passages are formed.

13. Strip material according to claim 1, characterised in that the 15 plastics layer (5, 6) is composed of a polyamide, polyester, polypropylene sulphite, polyetheretherketone, polyurethane, polysylfonene, polyphthalamide and/or polypropylene.

14. Strip material according to claim 1, characterised in that the plastics layer (5, 6) is composed of a mixture of plastics having different elasticities.

15. Strip material according to claim 1, characterised in that the plastics layer (5, 6) is composed of layers which are composed of plastics of different elasticities.

16. Strip material according to claim 1, characterised in that the support (2) is provided on both sides with a plastics layer (5, 6) traversed by the throughflow passages.

17. Strip material according to claim 7 and claim 16, characterised in that the number of pore cavities (10) of the second plastics layer (6) increases in the direction facing away from the support.

18. Strip material according to claim 7 and claim 16 or 17, characterised in that the individual volumes of the pore cavities (10) in the second plastics layer (6) increases in the direction facing away from the support (6).

19. Strip material according to claim 17, characterised in that the number of pore cavities (10) in the region adjoining the support (2) of the second plastics layer (6) at least equals the number of pore cavities (10) in the region of the first plastics layer (5) where it adjoins the support (2).

20. Strip material according to claim 17, characterised in that the individual volumes of the pore cavities (10) in the region of the second plastics layer (6), where it adjoins the support (2) at least equals the individual volumes of the pore cavities (10) in the region of the first plastics layer (5) where it adjoins the support (2).

21. Process for the manufacture of a strip material (1) according to claim 17 in which on at least one side of a support (2) a plastics layer (5, 6) is formed having throughflow passages, characterised in that during or after the production of the plastics layer (5, 6) soluble particles are applied onto the outside (7, 8) of the plastics layer (5, 6) and are then pressed into the plastics layer (5, 6), such soluble particles being leachable by a solvent of a type to which the remainder of the strip material (1) is stable and that thereafter these soluble particles are leached out.

22. Process according to claim 21, characterised in that the soluble particles are pressed into the plastics layer (5, 6) at a temperature thereof at which the plastics layer (5, 6) is softened as compared with its condition at room temperature.

23. Process according to claim 22, characterised in that the soluble particles are pressed in subsequently to the production of the plastics layer (5, 6) whilst its temperature is still elevated.

24. Process according to claim 21, characterised in that the plastics layer (5, 6) is provided with soluble components which are leachable to form throughflow passages by a solvent in respect of which the remainder of the strip material (1) is stable and that at least a portion of the soluble components present in the plastics layer (1) and the soluble particles pressed into the outside are leached out.

25. Process according to claim 24, characterised in that initially a plastics powder is formed and the plastics powder and the soluble components are applied onto the support (2) in the form of particulate soluble corpuscles and that by heat and pressure treatment the plastics powder is transformed into a plastics layer (5, 6), the outside of which is plane and which contains soluble corpuscles.

26. Process according to claim 25, characterised in that the mean particle size of the plastics powder is less than that of the soluble corpuscles.

27. Process according to claim 26, characterised in that the mean particle size of the plastics powder is not more than 100 $\mu$m.

28. Process according to claim 25, characterised in that the plastics powder and the soluble corpuscles are intermixed prior to their application onto the support (2).

29. Process according to claim 25, characterised in that the plastics powder and the soluble corpuscles are applied in a plurality of layers.

30. Process according to claim 25, characterised in that the soluble corpuscles increase inside from one layer to the next layer.

31. Process according to claim 25, characterised in that the number of soluble corpuscles increases from one layer to the next layer in the direction towards the support (2).

32. Process according to claim 25, characterised in that the plastics powder and the soluble corpuscles are intermixed in a volume ratio of from ¼:¾ and ½:½.

33. Process according to claim 24, characterised in that the soluble components and the soluble particles are composed of the same material.

34. Process according to claim 21, characterised in that inorganic substances are used to serve as the soluble components and particles respectively.

35. Process according to claim 34, characterised in that salts such as NaCl, KCl and/or $CaCO_3$ are used to serve as the inorganic substances.

36. Process according to claim 21, characterised in that organic substances or salts of organic acids are employed to serve as the soluble components and particles respectively.

37. Process according to claim 24, characterised in that soluble components in the form of soluble corpuscles are employed the mean diameter of which is in the range of 30 to 500 $\mu$m.

38. Process according to claim 21, characterised in that for being pressed into the outside of the plastics layer (5,6) soluble particles are employed the mean diameter of which is in the range of 5 to 100 $\mu$m.

39. Process according to claim 21, characterised in that anti-oxidants are added to the plastics powder.

40. Process according to at least claim 24, characterised in that soluble components of at least two substances are employed, each one such substance being leachable by a solvent in respect of which the other substance(s) is/are stable.

41. Process according to claim 21, characterised in that a plastics layer (6) having throughflow passages is also formed on the opposite side of the support (2).

* * * * *